United States Patent [19]

Hirayama

[11] 4,358,520

[45] Nov. 9, 1982

[54] METHOD OF STABILIZING AN ELECTROSTATIC LATENT IMAGE

[75] Inventor: Kazuhiro Hirayama, Yokohama, Japan

[73] Assignee: Canon Kabushiki Kaisha, Tokyo, Japan

[21] Appl. No.: 23,276

[22] Filed: Mar. 23, 1979

Related U.S. Application Data

[63] Continuation of Ser. No. 832,984, Sep. 13, 1977, abandoned.

[30] Foreign Application Priority Data

Sep. 17, 1976 [JP] Japan ..... 51-111562

[51] Int. Cl.[3] ..... G03G 13/22

[52] U.S. Cl. ..... 430/54; 430/66; 430/97; 430/902

[58] Field of Search ..... 96/1 R, 1 C; 355/3 CH, 355/14, 8, 10; 250/324; 118/668; 430/54, 66, 97, 902

[56] References Cited

U.S. PATENT DOCUMENTS

| | | | |
|---|---|---|---|
| 3,586,908 | 6/1971 | Vosteen | 250/324 |
| 3,666,363 | 5/1972 | Tanaka et al. | 355/10 |
| 3,734,609 | 5/1973 | Tanaka et al. | 355/8 |
| 3,749,488 | 7/1973 | De Lorme | 355/8 |
| 3,934,141 | 1/1976 | Vargas | 250/324 |
| 3,990,791 | 11/1976 | Tsukada | 355/14 CH |
| 4,019,102 | 4/1977 | Wallot | 355/14 CH |
| 4,105,321 | 8/1978 | Urso | 355/3 CH |
| 4,215,930 | 8/1980 | Miyakawa et al. | 118/668 |

*Primary Examiner*—John E. Kittle
*Assistant Examiner*—John L. Goodrow
*Attorney, Agent, or Firm*—Fitzpatrick, Cella, Harper & Scinto

[57] ABSTRACT

In the process of forming an electrostatic latent image on a photosensitive medium through at least two kinds of charging steps, the electrostatic latent image is stabilized by the steps of measuring the dark region potential $V_D$ and the light region potential $V_L$ on the photosensitive medium, comparing the measurement values with a predetermined referential dark region potential $V_{DR}$ and a predetermined referential light region potential $V_{LR}$, and when the differences between the $V_D$, $V_L$ and the $V_{DR}$, $V_{LR}$ are not within predetermined ranges, setting the amount of control by control functions f(x,y) and g(x,y), in which the differences $x=V_{DR}-V_D$ and $y=V_{LR}-V_L$ are variables, and varying the potential of the latent image on the photosensitive medium in accordance with the set amount of control.

13 Claims, 17 Drawing Figures

RESET

INITIAL SET: DRUM ROTATION NOT LESS THAN ONE FULL TURN
EP=EPO OK, VD ALARM VL ALARM LAMP—OFF
EAC=EACO EXPOSURE:DARK
MEASURE VD
EXPOSURE:LIGHT
DELAY UNTIL LIGHT PORTION REACHES PROBE
MEASURE VL
x=VDR-VD, y=VLD-VL
|x|<δ AND |y|<ε
YES
NO
OK → ON
OK → OFF
ΔEP=f(x,y), ΔEAC=g(x,y)
EP+ΔEP >EPMAX
YES
NO

FIG. 5
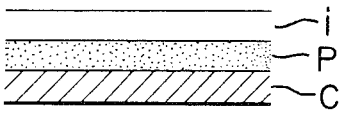
FIG. 6-1
(1) PRIMARY CHARGE
FIG. 6-2
(2) A.C DISCHARGE SIMULTANEOUS WITH IMAGE EXPOSURE
FIG. 6-3
(3) WHOLE SURFACE EXPOSURE
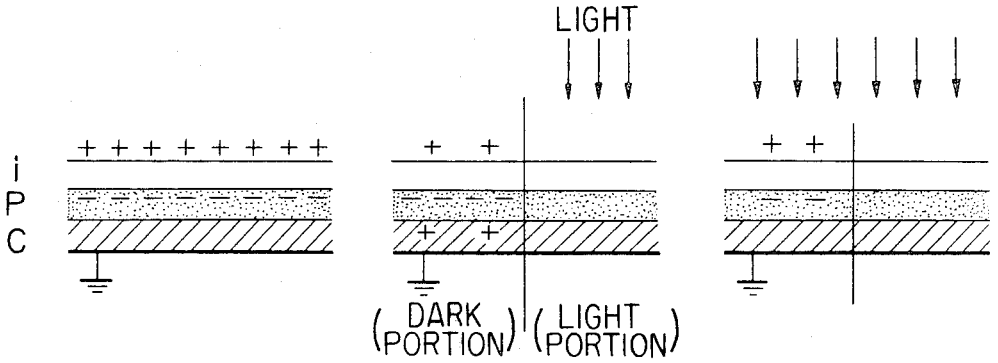
FIG. 6A
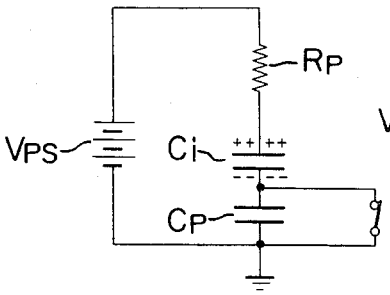
FIG. 6B
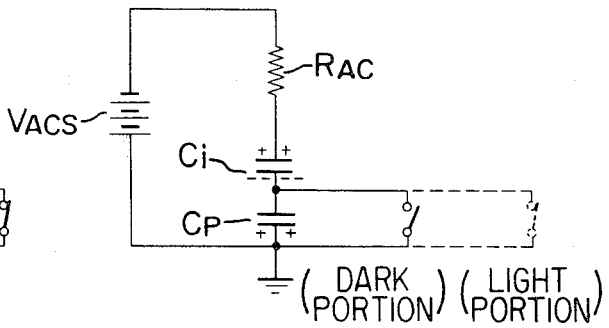
FIG. 6C
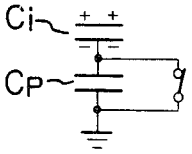

METHOD OF STABILIZING AN ELECTROSTATIC LATENT IMAGE

This is a continuation, of application Ser. No. 832,984 filed Sept. 13, 1977, now abandoned.

BACKGROUND OF THE INVENTION

1. Field of the Invention

This invention relates to a method of optimizing the electrostatic latent image formation process so as to stabilize an electrostatic latent image formed on a photosensitive medium by electrophotography, and more particularly to a method of quickly stabilizing the formed electrostatic latent image by quickly optimizing the latent image formation process including two kinds of electrostatically charging steps.

2. Description of the Prior Art

Various types of electrophotography have heretofore been proposed whereby an electrostatic latent image is formed on one of various types of photosensitive medium and transferred to a transfer medium after development or developed after transfer so that the formed image may be utilized, and several of these types including the Carlson process disclosed in U.S. Pat. No. 2,297,691 issued to C. F. Carlson have been put into practice. The image formed by electrophotography is readily affected by environmental conditions and stabilization of the electrostatic latent image formed thereby is very important in practice. First, the main factors contributing to the characteristic of the image formed by the common type of electrophotography include the characteristic of the photosensitive medium used, the characteristic of the charging means for sensitizing the photosensitive medium, the characteristic of the light source for exposure and its quantity of light, the developing characteristic, the image transfer characteristic, the characteristic of the transfer medium, the cleaning characteristic of residual developer, etc.

These characteristics are variable under the influence of temperature, humidity, contamination by dust, aging, etc., and this has intricately affected and varied the characteristic of the formed image.

For the stabilization of such image variation, a method of individually stabilizing each of the above-mentioned characteristic has heretofore been adopted and improvements of the respective characteristics have been advanced. However, ensuring the image in which different characteristics affect one another to be always stabilized is difficult to achieve by stabilizing the foregoing characteristics alone.

A method of stabilizing such an electrophotographically formed image is disclosed, for example, in U.S. Pat. No. 2,956,487, wherein in accordance with the so-called Carlson process, charge and image light are applied to xerography photosensitive medium to form an electrostatic latent image and when such image is developed and transferred, the quantity of light of the original image to which the photosensitive medium is to be exposed, the potential of the electrostatic latent image so formed or the density of the image after developed is detected so that the result of the detection is fed back to the charging and exposure means, etc. of the described process, thereby stabilizing the formed image. The factors making the electrostatic latent image unstable include variations in charging voltages, adherence of foreign materials to the charging electrode, aging of the charging electrode by its oxidation or the like, variations in characteristic of the corna discharge and in quantity of light of the image caused by temperature and humidity, fatigue of the photosensitive medium, variations in temperature and humidity characteristics of the photosensitive medium, etc. If these factors are within a predetermined range, it will be possible to stabilize the electrostatic latent image by measuring the potentials on the exposed and unexposed regions of the electrostatic latent image and varying the charging voltages and the quantity of exposure by the use of a feedback system.

The aforementioned U.S. patent controls the potential of the electrostatic latent image formed in accordance with the Carlson process, but once deterioration occurs to the photosensitive medium, the residual potential thereon is increased to vary the potential on the exposed region, thus making it difficult to stabilize the latent image.

Also, U.S. Pat. No. 3,586,908 discloses a system wherein the difference between the detected potential and the reference potential is applied to an integrator to control the output voltage in order to control the charging. Any of these methods is to control the Carlson process wherein latent image is formed by only one kind of charging step.

In contrast with such a latent image formation process which requires only one kind of charging step, the type of process which involves two or more kinds of charging steps for the electrostatic latent image formation is disclosed, for example, in U.S. Pat. Nos. 3,666,363 and 3,734,609, wherein the charging means for carrying out the respective charging steps are controlled to thereby enable the potentials on the exposed and the unexposed regions of the formed electrostatic latent image to be varied, and this type of process has thus been found to be suitable for the realization of stabilized image formation. Nevertheless, it has also been found that even if a feedback is applied from the heretofore contrived means for measuring the potential of the latent image to each charging means, a long time is required for the potential of the latent image to be converged and stabilized to a reference value. This is because, with only one of the charging means being set, the electrostatic latent image can not be stabilized and moreover, variation in one of the charging means affects the charging effected by the other charging means.

SUMMARY OF THE INVENTION

In view of the above-noted points, the present invention improves the electrostatic latent image formation process including two or more kinds of charging steps.

Generally describing, the present invention enables, in the process of forming an electrostatic latent image on a photosensitive medium through at least two kinds of charging steps, an ultimately stable electrostatic latent image to be obtained by measuring the dark region potential $V_D$ and the light region potential $V_L$ on the photosensitive medium, comparing the measurement values with a predetermined referential dark region potential $V_{DR}$ and a predetermined referential light region potential $V_{LR}$, and when the differences between said $V_D$, $V_L$ and said $V_{DR}$, $V_{LR}$ are not within predetermined ranges, setting the amount of control by control functions f(x,y) and g(x,y), in which the differences $x=V_{DR}-V_D$ and $y=V_{LR}-V_L$ are variables, and varying the potential of the latent image on the photosensitive medium in accordance with said set amount of control.

The method and apparatus of the present invention, as will be understood from a specific embodiment fully described hereinafter, can very quickly stabilize the electrostatic latent image and yet can quickly set the optimal conditions for the stabilization in compliance with environmental conditions.

It is therefore an object of the present invention to provide a method of quickly stabilizing an electrostatic latent image in the process of forming an electrostatic latent image on a photosensitive medium through at least two kinds of charging steps.

It is another object of the present invention to provide a method of quickly stabilizing an electrostatic latent image in compliance with variations in environmental conditions.

It is still another object of the present invention to provide an apparatus for carrying out the process of forming an electrostatic latent image on a photosensitive medium through at least two kinds of charging steps, thereby forming a stabilized electrostatic latent image.

The invention will become more fully apparent from the following detailed description thereof taken in conjunction with the accompanying drawings.

BRIEF DESCRIPTION OF THE DRAWINGS

FIG. 5 illustrates the construction of a photosensitive medium used with the process according to the embodiment of the present invention.

FIGS. 6(1), (2) and (3) illustrate the charge distribution on the photosensitive medium during the respective ones of the primary charging step, the simultaneous AC discharge and exposure step and the whole surface exposure step in the process according to the embodiment of the present invention.

FIGS. 6(*a*), (*b*) and (*c*) are equivalent circuit diagrams corresponding to FIGS. 6(1), (2) and (3), respectively.

DESCRIPTION OF THE PREFERRED EMBODIMENTS

Figure 1:
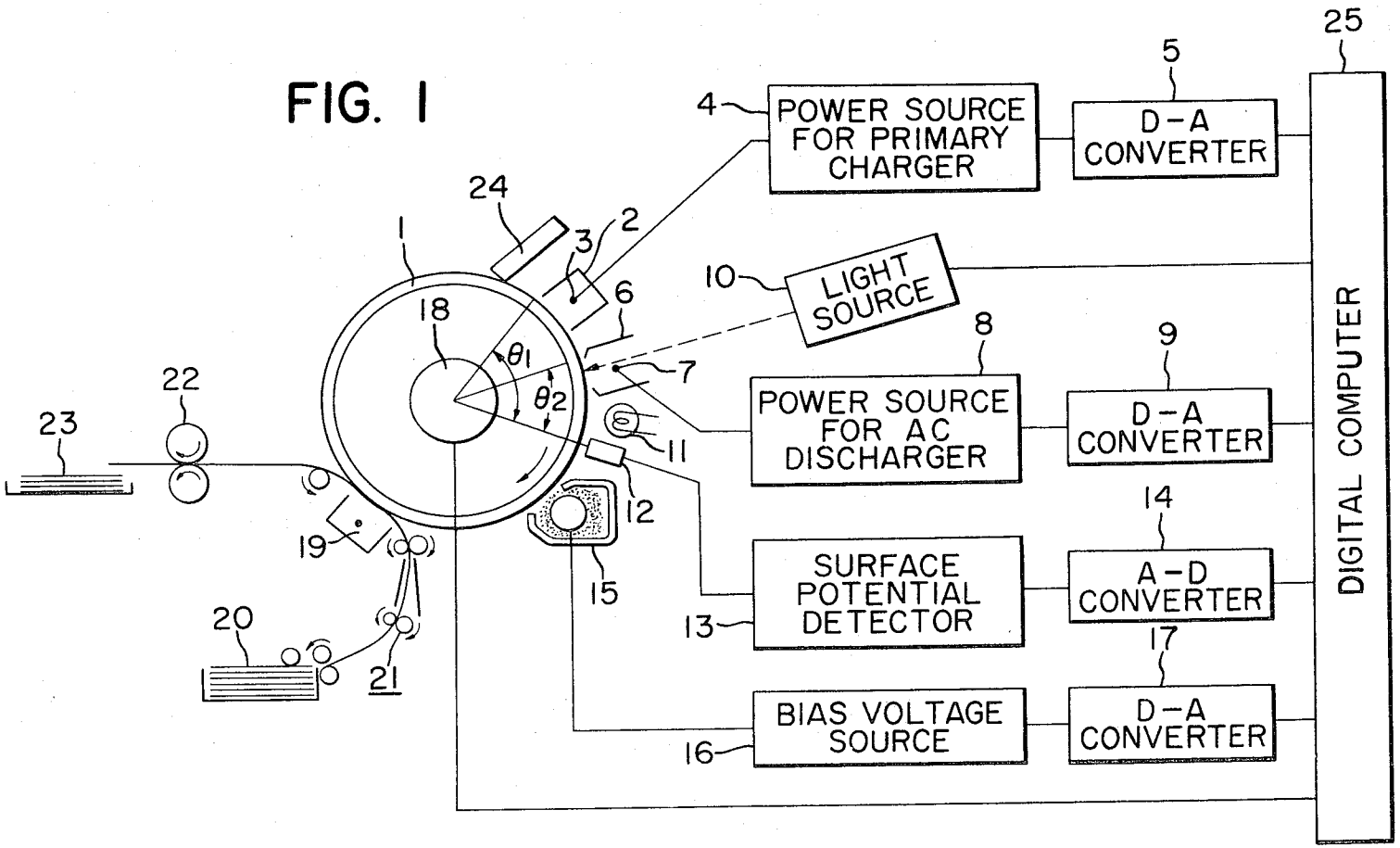
FIG. 1 illustrates the apparatus according to an embodiment of the present invention.

FIG. 1 shows, in side view, an apparatus for carrying out the electrostatic latent image formation process including two kinds of charging steps to which the present invention pertains.

This electrostatic latent image formation process utilizes the process disclosed in U.S. Pat. No. 3,666,363 (Japanese Patent Publication No. 23910/1967) which uses a photosensitive medium basically comprising a photoconductive layer and an insulative layer layered successively on an electrically conductive back-up member.

A photosensitive drum 1 comprising such a photosensitive medium shaped in the form of a drum is rotatively driven in the direction of the arrow by drive means, not shown. The photosensitive medium is subjected to uniform corona discharge by a primary charger 2, whereafter it is subjected to AC corona discharge by an AC charger 6 while, at the same time, it is subjected to image exposure by an exposure light source 10, and then the photosensitive medium is subjected to uniform whole surface exposure. In this manner, an electrostatic latent image with high contrast is obtained on the surface of the photosensitive drum 1. This electrostatic latent image is developed in a developing device 15 by the use of developer comprising charged toner particles and magnetic carrier. The toner image thus obtained by the development is transferred to a sheet of transfer paper, which is fed to between the photosensitive drum 1 and an image transfer charger 19 in synchronism with the photosensitive drum, by imparting corona discharge to the transfer paper from the image transfer charger 19.

The transfer paper having the toner image so transferred thereto is passed through a fixing device 22 comprising a heating and a pressing roller for fixation of the toner image. The surface of the photosensitive drum still carrying thereon some residual toner is cleaned by a cleaning device 24 for removal of the residual toner, thus becoming ready for the next electrostatic latent image formation process.

In the apparatus shown in FIG. 1, a probe 12 for measuring the surface potential of the photosensitive drum 1 is disposed at a location subsequent to the whole surface exposure lamp 11. The probe must not substantially disturb the electrostatic charge image on the surface of the photosensitive medium, and may be any of various probes conventionally used, such as vibration capacity type probes. The probe 12 is coupled to a surface potential measuring device 13 and supplied with necessary signal therefrom. The surface potential measuring device 13 generates a voltage proportional to the potential measured by the probe. The generated voltage is applied through an A/D converter 14 to a digital computer 25. As will further be described, the digital computer 25 also receives input signal from a drum rotation pulse generator 18 and the output signals of the computer 25 is connected to various process means through D/A converters 5, 9, 17 and so on.

Figure 2:
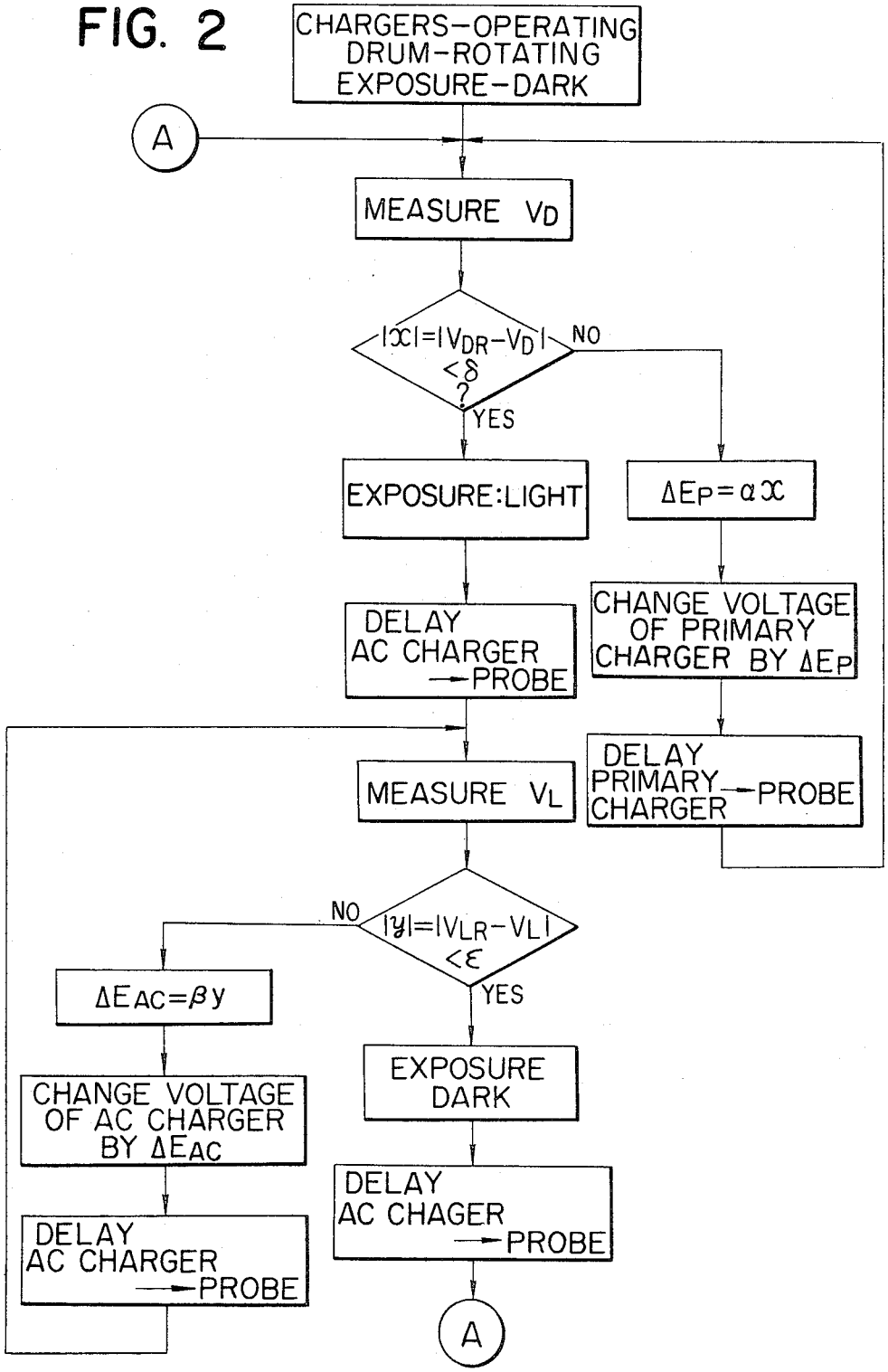
FIG. 2 is a flow chart for illustrating the basic procedures for rendering the surface potential of the photosensitive medium to a predetermined level according to the present invention.

To make the method of the present invention readily understood, FIG. 2 shows the basic procedures for providing a constant surface potential on the photosensitive medium. First, the potential $V_D$ on the unexposed region of the latent image (hereinafter referred to as the dark region potential) is measured and compared with a predetermined referential dark region potential $V_{DR}$ to obtain the potential difference therebetween, $x=V_{DR}-V_D$, and whenever the potential difference is not in accord with a predetermined value, a voltage $\Delta Ep$ proportional to the x is applied while being superposed, for example, on a voltage Ep which is being applied to the primary charger 3. After the wait time until the effect of variation of this voltage applied to the primary charger 3 is detected by the probe (delay primary→probe), $V_D$ is again measured and such a cycle is repeated until the potential difference $|x|$ assumes the predetermined value $\delta$. Subsequently, the potential $V_L$ on the exposed region of the latent image (hereinafter referred to as the light region potential) is measured and compared with a predetermined referential light region potential $V_{LR}$ to obtain the potential difference therebetween, $y=V_{LR}-V_L$. Whenever this potential difference $|y|$ is not in accord with a predetermined value $\epsilon$, a voltage $\Delta E_{AC}$ proportional to the y is applied while being superposed, for example, on a voltage $E_{AC}$ which is being applied to the AC charger 6. After the wait time until the effect of variation of the voltage $E_{AC}$ is detected by the probe (delay AC→probe), $V_L$ is again measured and such a cycle is repeated until $|y|$ comes into the range of a predetermined value $\epsilon$. Then, even if $|y|$ assumes the predetermined value, $|x|$ in turn is varied and therefore, the above-described procedure is repeated until $|x|<\delta$ and $|y|<\epsilon$ are realized simultaneously.

A relatively long time of drum rotation (several to ten and several full rotations) is required before the electrostatic latent image is stabilized by this method. Such time required to stabilize the electrostatic latent image is determined by the measuring time and the time required for comparison of the measured value, but substantially dominated by the measuring time because the operation processing time of the digital computer is of the order of several microseconds. This measuring time also depends on the wait time required before the effect of voltage variation is detected by the probe and thus, the time required for the angular displacement as indicated by $\theta_1$ and $\theta_2$ in FIG. 1 is necessary. In the appartus of the illustrated embodiment, 1.11 sec. is required for the angular displacement through $\theta_1$, and 0.75 sec. for the angular displacement through $\theta_2$. Accordingly, the measuring time required in the present case is as shown in Table 1 below.

TABLE 1

| | |
|---|---|
| Primary votage applied → $V_D$ measured | 1.11 (sec.) |
| Primary corrected → $V_D$ measured [$V_D$ is OK.] | 1.11 |
| Light ON → $V_L$ measured | 0.72 |
| AC corrected → $V_L$ measured [$V_L$ is OK.] | 0.75 |
| Light OFF → $V_D$ measured | 0.72 |
| Primary corrected → $V_D$ measured [$V_D$ is OK.] | 1.11 |
| Light ON → $V_L$ measured | 0.72 |
| AC corrected → $V_L$ measured [$V_L$ is OK] | 1.75 |
| Light OFF → $V_D$ measured | 0.72 |
| Primary corrected → $V_D$ measured [$V_D$ is OK.] | 1.11 |
| Light ON → $V_L$ measured [completed with $V_L$ being OK.] | 0.72 |
| Total | 9.54 (sec.) |

NOTE:
In the measurement during "Light ON", the condition after the passage of the whole area of the AC charger need not be measured unlike the case of AC correction and thus, the required time is as short as 0.72 sec.

The following method would occur to mind as a method of reducing the time for stabilizing the above-described basic procedure.

Figure 3:
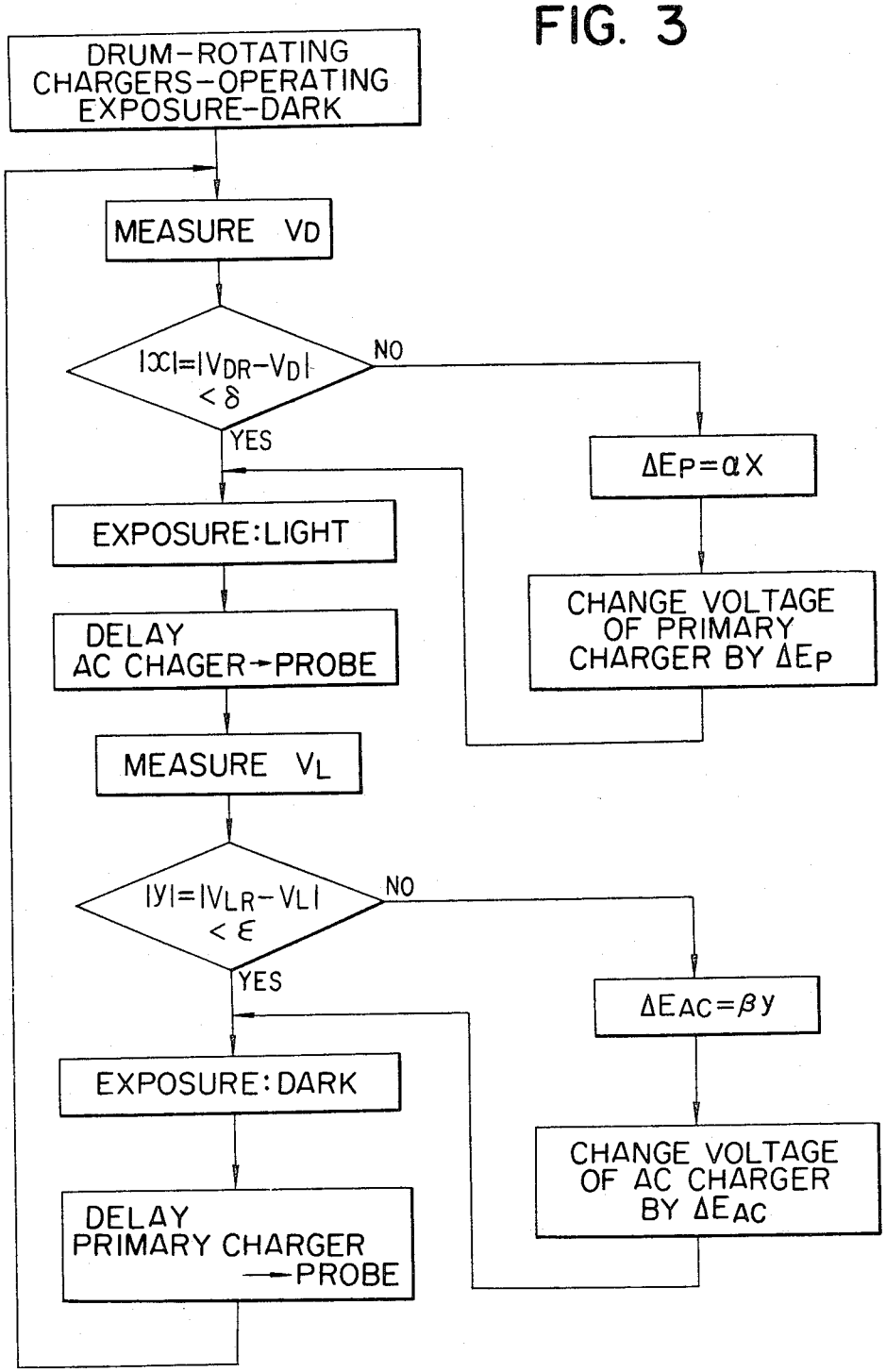
FIG. 3 is a flow chart for illustrating the procedures improved over the basic procedures to reduce the required time.

First, the photosensitive drum is rotated with the exposure maintained under dark condition, and the dark region potential $V_D$ is measured. The value measured by the probe is compared with the referential potential $V_{DR}$ and if the potential difference $|x|$ is not in accord with the predetermined value $\delta$, the primary voltage is varied by $\Delta Ep=\alpha x=\alpha(V_{DR}-V_D)$. On the other hand, the photosensitive medium is already charged from dark condition to light condition and so, the light region potential $V_L$ is measured immediately after the dark region potential $V_D$ has been measured. If this potential difference $|y|$ is not in accord with the predetermined value $\epsilon$, the AC voltage is varied by $\Delta E_{AC}=-\beta y=\beta(V_{DR}-V_D)$. Subsequently, the surface of the photosensitive medium is changed to dark condition and the time required till the detection of the effect of the previously varied primary voltage and AC voltage is waited for, whereafter the above-described procedure is repeated to converge the potential differences $|x|$ and $|y|$ so that $|x|<\delta$ and $|y|<\epsilon$. The flow chart for this method is shown in FIG. 3. In this manner, the time required may effectively be shortened to one-third to one-fifth of the time required in the method of FIG. 2.

However, the basic method as described above may undesirably require very much time for the stabilization if the voltage of each charging means is greatly fluctuated by changes of environmental or other conditions, although the thing is not so serious when the voltage of each charging means is fluctuated in the vicinity of its optimal value. Also, the remarkably variable stabilizing time under various conditions may practically offer an inconvenience to the control of the electrostatic latent image formation process.

Description will now be made of a method of stabilizing the electrostatic latent image which is improved over the above-described basic method.

First, the photosensitive drum 1 is rotated under dark condition, and then subjected to exposure to render it into light condition. The dark region potential $V_D$ is measured as the dark region of the photosensitive drum passes by the probe 12, and subsequently the light region potential $V_L$ is measured as the light region of the photosensitive drum passes by the probe 12. The measurement values are compared with the respective referential potentials $V_{DR}$ and $V_{LR}$ to obtain $x=V_{DR}-V_D$ and $y=V_{LR}-V_L$. If x and y are not in accord with the predetermined values $\delta$ and $\epsilon$, they are substituted into functions f(x,y) and g(x,y), in which x and y are variables which determine the voltages to be applied, thus determining $\Delta Ep=f(x,y)$ and $\Delta E_{AC}=g(x,y)$. Primary voltages Ep and AC voltage $E_{AC}$ are varied in accordance with these determined values. This process is repeated until $|x|<\delta$ and $|y|<\epsilon$ are attained.

Figure 4A:
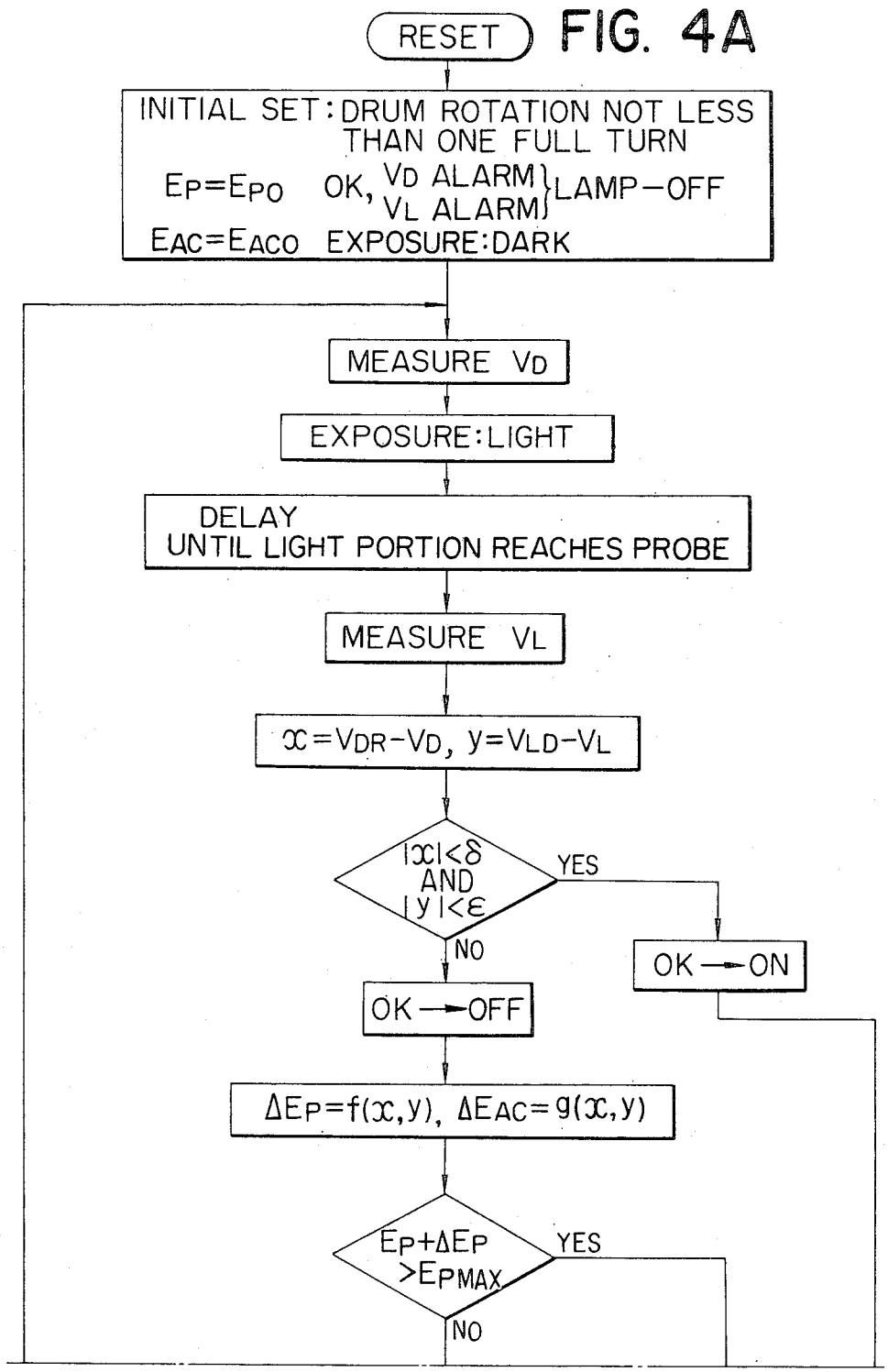
FIG. 4A and 4B are a flow chart for illustrating specific procedures according to the present invention.
Figure 4B:
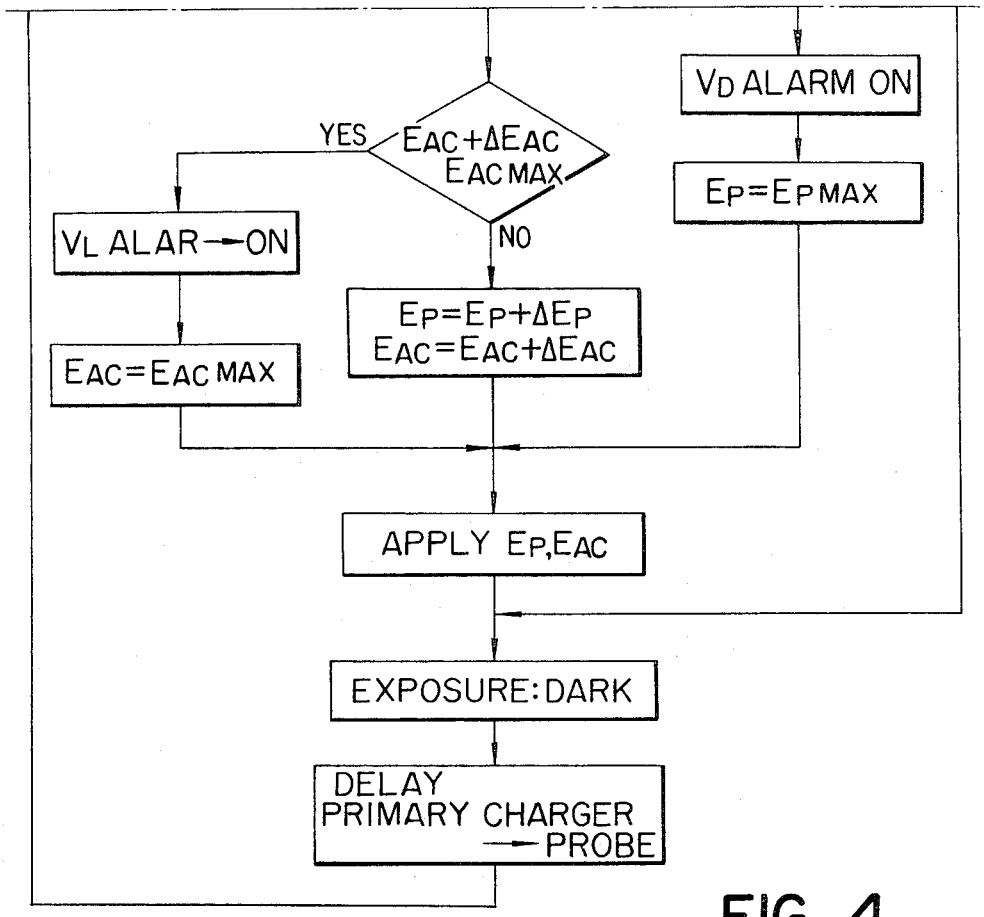
Figure 4:
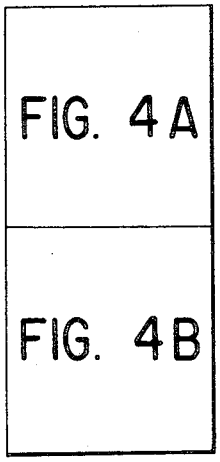

By the aforementioned functions f(x,y) and g(x,y) being suitably determined, the convergence of the potential differences could be realized in one or two repetitions of the procedure, thereby stabilizing the electrostatic image. The flow chart for this method is shown in FIG. 4. FIG. 4 further shows the procedure of judging whether the voltages to be applied exceed their predetermined maximum values when $\Delta Ep$ and $\Delta E_{AC}$ are obtained, and producing an alarm if they exceed the maximum values. This procedure is particularly effective in that the alarm produced tells occurrence of abnormality in the latent image formation process (for example, break of the charging wire, abnormality of the high voltage source, abnormality of the exposure lamp or the like) and also tells the fatigue of the photosensitive drum (reduced contrast resulting from aging or repetitive use of the drum).

Practically, when $|x|<\delta$ and when $|y|<\epsilon$, the sequence flows to the bypass line not requiring the function calculations, and at this time, the OK lamp is turned on to assist the operator.

Table 2 below shows the time required to stabilize the electrostatic latent image in the manner described above.

TABLE 2

| | |
|---|---|
| Primary and AC applied → $V_D$ measured | 1.11 sec. |
| Light ON → $V_L$ measured | 0.72 |
| Primary and AC corrected → $V_D$ measured (Light OFF) | 1.11 |
| Light ON → $V_L$ measured | 0.72 |
| [completed with $V_D$ and $V_L$ being OK.] | |
| Total | 3.66 sec. |

Further, for the reduction of the stabilizing time, it is preferable to provide at least two probes capable of exclusively measuring the dark and the light region potential of the photosensitive medium so as to enable the two measurements to be completed substantially simultaneously. In such a case, it is recommendable to ensure corresponding dark and light patterns to be always formed at the locations on the photosensitive medium whereat the probes are set. As example of the time required to provide stabilization in this manner is shown in Table 3 below.

TABLE 3

| | |
|---|---|
| Primary and AC applied (light, dark patterns) | → $V_D$, $V_L$ measured 1.11 sec. |
| Primary corrected, AC corrected (light, dark patterns) [$V_D$, $V_L$ OK, completed] | → $V_D$, $V_L$ measured 1.11 |
| Total | 2.22 sec. |

How to determine the aforementioned functions f(x,y) and g(x,y) which determine the voltages to be applied will now be discussed with respect to the process disclosed in the aforementioned U.S. Pat. No. 3,666,363 (Japanese Patent Publication No. 23910/1967). FIG. 5 illustrates the construction of the photosensitive medium which comprises an electrically conductive substrate C, a photoconductive layer P formed by CdS secured on the conductive substrate by means of resin binder, and a transparent insulative layer i such as film of polyethylene terephthalate or the like provided on the surface of the insulative layer.

FIGS. 6(1), (2) and (3) illustrate the charge distribution on each layer of the photosensitive medium during the primary charging step, the simultaneous AC discharge and exposure step and the whole surface exposure step, respectively, of the above-mentioned process. During the primary charging step of FIG. 6(1), when positive charge is imparted to the surface of the insulative layer of the photosensitive medium, negative charge is introduced from the conductive substrate and captured in the interface between the photoconductive layer and the insulative layer.

During the simultaneous AC discharge and exposure step of FIG. 6(2), the negative charge captured in the interface between the photoconductive layer and the insulative layer is not liberated from the unexposed dark region, and the positive charge induced on the surface of the insulative layer and the positive charge induced on the conductive substrate counter-balance said negative charge, thus providing substantially zero potential on the surface of the insulative layer. On the other hand, in the light region, the negative charge in the photoconductive layer is readily liberated and the charge on the insulative layer surface is also removed, thus providing substantially zero potential on the photoconductive layer surface as well.

During the whole surface exposure step of FIG. 6(3), when light is projected on the whole surface of the photosensitive medium, no charge occurs in the light region, whereas in the dark region the positive charge induced on the conductive substrate offsets part of the negative charge so far captured in the interface between the conductive layer and the insulative layer and now liberated therefrom, so that a positive potential appears on the surface of the insulative layer, thereby creating electrostatic contrast. FIGS. 6(*a*), (*b*) and (*c*) show models of the equivalent circuits corresponding to the above-described steps, and symbols appearing therein are of the following significances:

Ci: electrostatic capacity of the insulative layer

Cp: electrostatic capacity of the photoconductive layer

Figure 7:
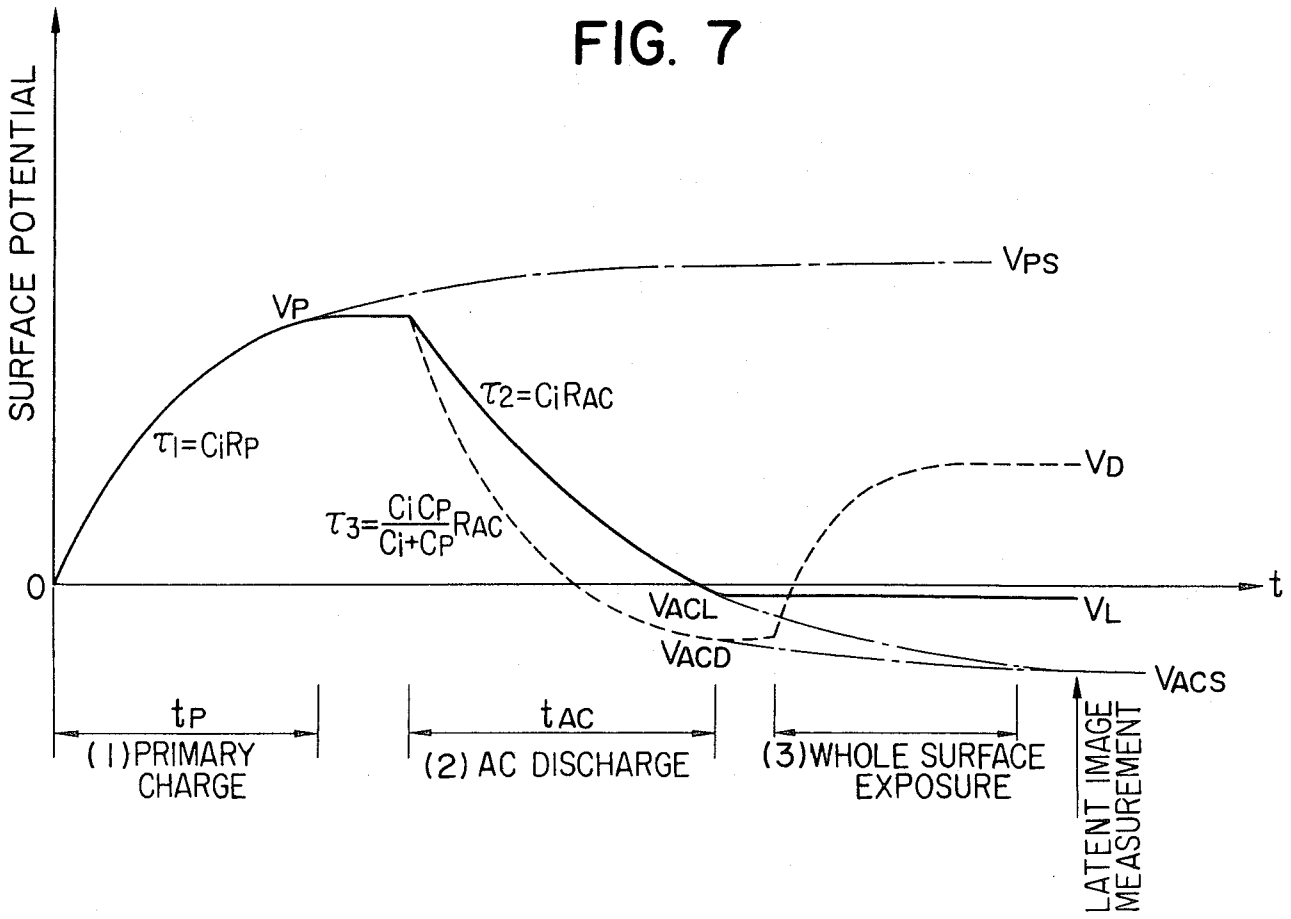
FIG. 7 graphically illustrates the variations in surface potential according to the process of the present invention.

Rp: corona discharge resistance during primary charge $R_{AC}$: corona discharge resistance during AC discharge Vps: saturated surface potential during primary charge $V_{ACS}$: saturated surface potential during AC discharge FIG. 7 illustrates variations in surface potential caused by the respective steps of the above-described process.

Figure 8:
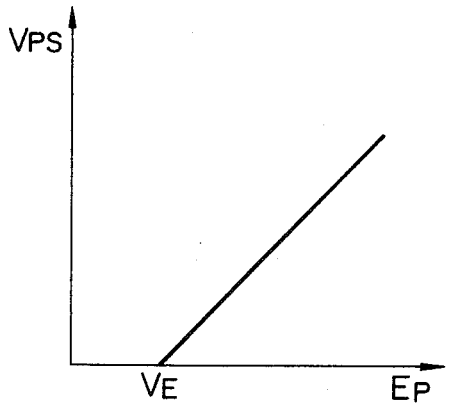
FIG. 8 is a graph illustrating the relationship between the voltage applied for primary charging and the resultant saturated surface potential of the photosensitive medium.

During the primary charging time tp, the potential increases at time constant $\tau_1=CtRp$ and a primary surface potential Vp is obtained at the end of the primary charge. Next, during the AC discharge time, the potential in the light region is varied at time constant $\tau_2=CiR_{AC}$ and a potential $V_{ACL}$ is obtained at the end of the AC discharge. On the other hand, in the dark region, the potential is varied at time constant $$\tau_3=\frac{CiCp}{Ci+Cp}R_{AC}$$

and a potential $V_{ACD}$ is obtained. Further, after the whole surface exposure, a light region potential $V_L$ and a dark region potential $V_D$ are obtained. FIG. 8 illustrates the relationship between the voltage Ep applied to the primary charger and the saturated potential $V_{PS}$ on the photosensitive medium surface resulting from the primary charge.

$$Vps=Ep-V_E \qquad (0_1)$$

Figure 9:
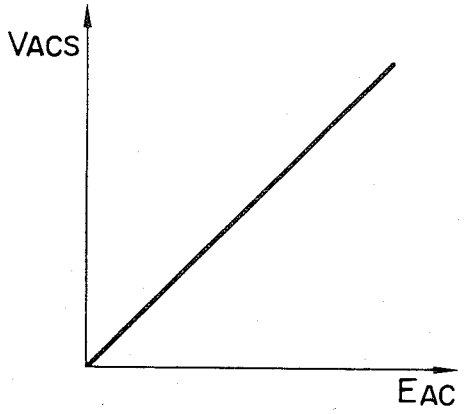
FIG. 9 is a graph illustrating the relationship between AC bias voltage and the resultant saturated surface potential of the photosensitive medium.

FIG. 9 illustrates the relationship between the AC bias voltage $E_{AC}$ applied to the AC discharge and the satureted surface potential $V_{ACS}$ resulting therefrom.

$$V_{ACS}=E_{AC} \qquad (0_2)$$

Under these conditions, f(x,y) and g(x,y) are to be obtained:

$$Vp=Vps(1-e^{\alpha})=(Ep-V_E)(1-e^{\alpha}) \qquad (1)$$

$$V_{ACL}=Vp+(V_{ACS}-Vp)(1-e^{\beta}) \qquad (2)$$

$$V_{ACD}=Vp+(V_{ACS}-Vp)(1-e^{\gamma}) \qquad (3)$$

$$V_L = V_{ACL} \tag{4}$$

$$V_D = V_{ACD} + (V_p - V_{ACD})\frac{Ci}{Ci + Cp} \tag{5}$$

$$\left(\text{where } \alpha = -\frac{tp}{\tau_1},\ \beta = -\frac{t_{AC}}{\tau_2},\ \gamma = -\frac{t_{AC}}{\tau_3}\right)$$

From equations (1) to (5), Ep and $V_{ACS}(=E_{AC})$ may be expressed by the use of $V_L$ and $V_D$, as follows:

$$Ep = \frac{Cp(e^{\gamma} - 1)}{(1 - e^{\alpha})\{Cp(e^{\gamma} - e^{\beta}) + Ci(1 - e^{\beta})\}} V_L + \frac{(Ci + Cp)(1 - e^{\beta})}{(1 - e^{\alpha})\{Cp(e^{\gamma} - e^{\beta}) + Ci(1 - e^{\beta})\}} V_D + V_E \tag{6}$$

$$\begin{aligned} E_{AC} &= V_{ACS} \\ &= \left\{\frac{1}{e^{\gamma} - e^{\beta}} + \left(\frac{Ci/Cp}{e^{\gamma} - e^{\beta}} + 1\right)\frac{Cp(e^{\gamma} - 1)}{Cp(e^{\gamma} - e^{\beta}) + Ci(1 - e^{\beta})}\right\} V_L + \\ &\quad \left\{\frac{-(Ci + Cp)/Cp}{e^{\gamma} - e^{\beta}} + \left(\frac{Ci/Cp}{e^{\gamma} - e^{\beta}} + 1\right)\frac{(Ci + Cp)(1 - e^{\beta})}{Cp(e^{\gamma} - e^{\beta}) + Ci(1 - e^{\beta})}\right\} V_D \end{aligned} \tag{7}$$

Place A and B as the coefficients of $V_L$ and $V_D$ in equation (6) and C and B as the coefficients of $V_L$ and $V_D$ in equation (7). Equations (6) and (7) are rewritten as:

$$Ep = AV_L + BV_D + V_E \tag{8}$$

$$E_{AC} = CV_L + DV_D \tag{9}$$

Assume that $V_{LR}$ and $V_{DR}$ are obtained when Epo and $E_{ACO}$ are applied. Then, $$Epo = AV_{LR} + BV_{DR} + V_E \tag{10}$$

$$E_{ACO} = CV_{LR} + DV_{DR} \tag{11}$$

If $V_L = V_{LR} - y$ and $V_D = V_{DR} - x$ when Ep' and $E_{AC}'$ are applied, then $$Ep' = A(V_{LR} = y) - B(V_{DR} - x) + V_E \tag{12}$$

$$E_{AC}' = C(V_{LR} - y) + D(V_{DR} - x) \tag{13}$$

Hence, $$\Delta Ep = Epo - Ep' = Ay + Bx \tag{14}$$

$$\Delta E_{AC} = E_{ACO} - E_{AC}' = Cy + Dx \tag{15}$$

ΔEp and $\Delta E_{AC}$ are expressed as the functions of x and y.

From this, it follows that if A, B, C and D are constant, x=0 and y=0 may be realized by measuring x and y and by carrying out the procedure of FIG. 4 only once.

In the actual use, Rp, $R_{AC}$, ci, cp, etc. may be varied with atmosphere, temperature, humidity or aging and even if the reference voltages Epo and $E_{ACO}$ are applied to the primary charger and the AC discharger, the measurements by the probes may sometimes be $x \neq 0$ and $y \neq 0$. However, if the procedure of FIG. 4 is followed to obtain ΔEp and $\Delta E_{AC}$ from measurements and by equations (14) and (15), then $|x| < \delta$ and $|y| < \epsilon$ may be obtained in a minimum time and stabilization of the electrostatic image may be realized quickly.

Equations (14) and (15) above are the results obtained on the assumption shown in FIGS. 6 to 9 and they somewhat differ from the actual forms of functions of ΔEp and $\Delta E_{AC}$ but this does not obstruct the practicability. To further enhance the accuracy, it is necessary to apply the procedure of FIG. 3 for various initial values of $V_D$ and $V_L$, to thereby measure the variations ΔEp and $\Delta E_{AC}$ in the voltages to be applied before the reference values $V_{DR}$ and $V_{LR}$ are finally obtained, thus correcting the coefficients of the respective functions.

Description will hereinafter be described of how to quickly determine the coefficients of the respective functions. This method is to determine substantially practical and highly accurate function coefficients empirically from a few measurement values.

From equation (4) above, $$\begin{aligned} V_L &= V_{ACL} \\ &= e^{\beta}Ep + a(1 - e^{\beta})E_{AC} + \{b(1 - e^{\beta}) + V_E e^{\beta}(1 - e^{\alpha})\} \end{aligned} \tag{16}$$

From equation (5), $$\begin{aligned} V_D &= V_{ACD} + (V_p - V_{ACD})\frac{Ci}{Ci + Cp} \\ &= \left\{e^{\gamma}(1 - e^{\gamma})\left(1 - \frac{Ci}{Ci + Cp}\right) + \frac{Ci'}{Ci + Cp}(1 - e^{\gamma})\right\} Ep + \\ &\quad \left\{a(1 - e^{\gamma})\left(1 - \frac{Ci}{Ci + Cp}\right)\right\} E_{AC} + \\ &\quad \left[\left(1 - \frac{Ci}{Ci + Cp}\right\{b(1 - e^{\gamma}) - V_E e^{\gamma}(1 - e^{\gamma})\} - V_E(1 - e^{\gamma})\frac{Ci}{Ci + Cp}\right] \end{aligned} \tag{17}$$

$$\text{where } \alpha = -\frac{tp}{\tau_1},\ \beta = -\frac{t_{AC}}{\tau_2},\ \gamma = -\frac{t_{AC}}{\tau_3}.$$

Rewrite equations (16) and (17) to obtain:

$$V_L = PEp + QE_{AC} + R \tag{16'}$$

$$V_D = SEp + TE_{AC} + U \tag{17'}$$

Assume that P, Q, R, S, T and U are not the functions of Ep and $E_{AC}$. (This is empirically true, too.) Therefore, $$y = \Delta V_L = P\Delta Ep + Q\Delta E_{AC} \tag{18}$$

$$x=\Delta V_D=S\Delta Ep+T\Delta E_{AC} \quad (19)$$

Solve equations (18) and (19) with respect to ΔEp and $\Delta E_{AC}$. to obtain:

$$\Delta Ep = \frac{-T}{SQ-PT}y + \frac{Q}{SQ-PT}x \quad (20)$$

$$\Delta E_{AC} = \frac{S}{SQ-PT}y - \frac{P}{SQ-PT}x \quad (21)$$

Compare equations (14) and (15) with equations (20) and (21) to obtain:

$$A = \frac{-T}{SQ-PT} \quad (22)$$

$$B = \frac{Q}{SQ-PT} \quad (23)$$

$$C = \frac{S}{SQ-PT} \quad (24)$$

$$D = \frac{-P}{SQ-PT} \quad (25)$$

Thus, if $V_L$, $V_D$ corresponding to six sets of values of Ep and $E_{AC}$ are measured to solve the simultaneous equations, each of P, Q, R, S, T and U are obtained, but they are based on the measured data and so, very great errors might occur.

Figure 10:
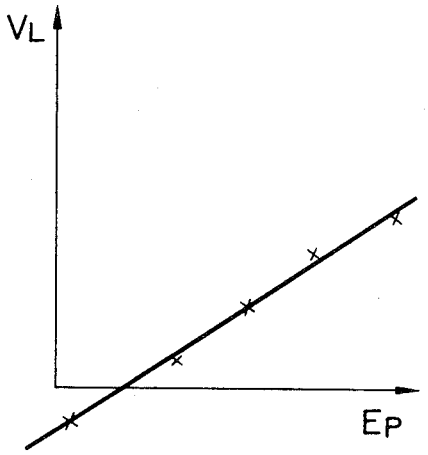
FIG. 10 is a graph illustrating the $Ep-V_L$ characteristic according to an example of the measurement for determining the coefficients of functions.

According to the present method, equations (18) and (19) are utilized to determine P to U and determine the values of A, B, C and D with high accuracy. Thus, in order to evaluate P, Ep is varied with $E_{AC}$ as constant and $V_L$ corresponding to a plurality of values of Ep is evaluated (See FIG. 10).

From the plurality of values, P is obtained as the linear gradient obtained by the use of a minimum squaring method.

As regards Q, $E_{AC}$ is varied with Ep as constant and Vc corresponding to a plurality of values of $E_{AC}$ is evaluated likewise. From this measurement value, Q can be evaluated.

S and T may also be evaluated in a similar manner.

From the values of P, Q, R and S so determined, A to D may be evaluated by the use of equations (22) to (25) and the values so obtained are of great accuracy.

In this manner, coefficients of the aforementioned functions f(x,y) and g(x,y) are determined with good accuracy. These coefficient values may of course be stored as non-volatile memory in a digital computer.

By using the above-described program of measuring each potential value and determining the coefficient of each function, it is possible to determine the coefficient of each function after the apparatus has been installed at its service position. Also, each time the photosensitive drum, the charger or other process means is replaced, their coefficients can be re-determined and this greatly enhances the stability in the use of the apparatus.

The above-described control method is carried out by a digital computer 25 in the apparatus of the embodiment as shown in FIG. 1.

Figure 11:
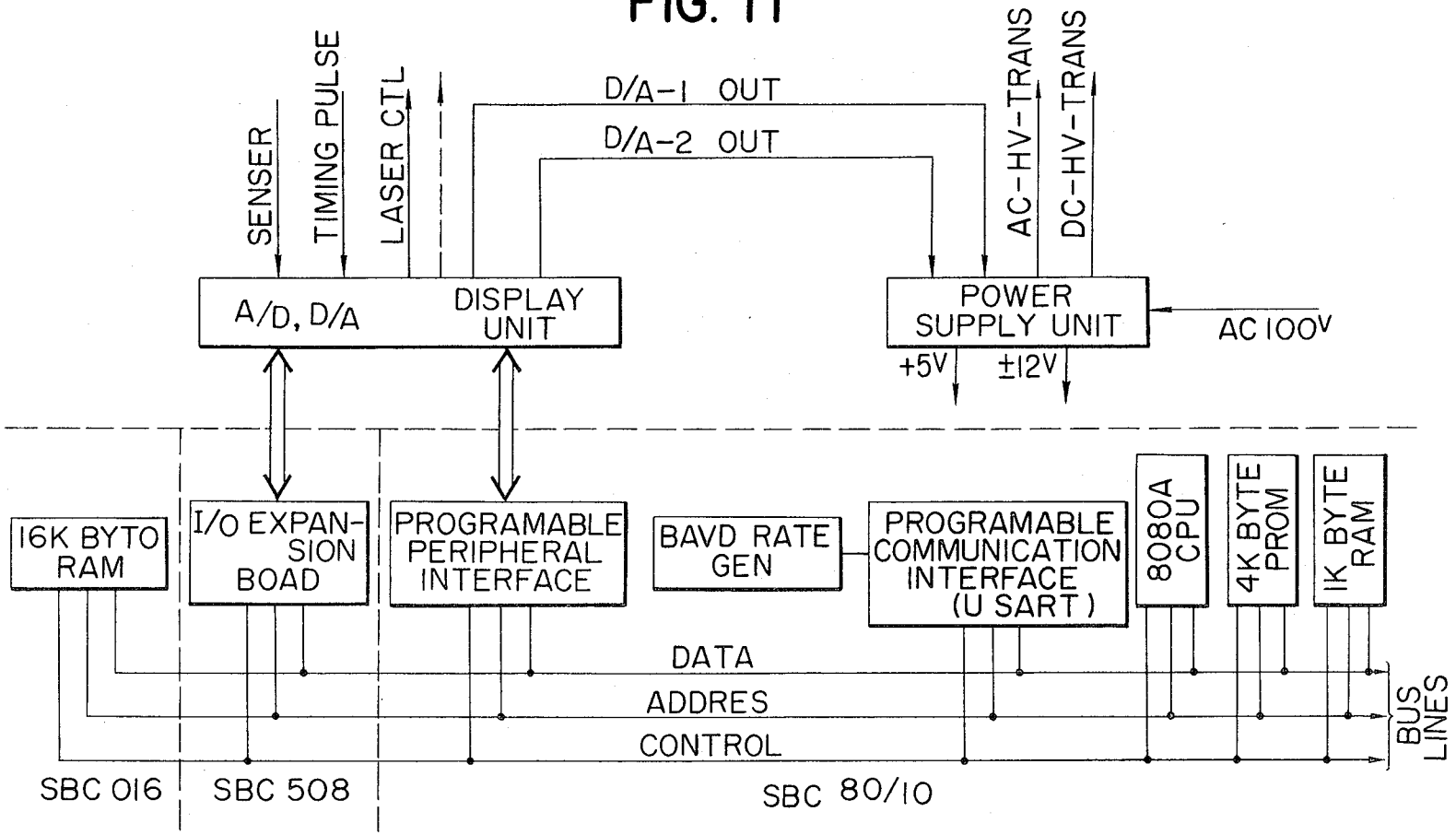
FIG. 11 illustrates a specific construction of digital computer.

Construction and operation of the digital computer and its adjacent portions will hereinafter be described. In the embodiment of the present invention, as shown in FIG. 11, the digital computer comprises a computer board (SBC 80/10) equipped with 8080A CPU, 4KPROM, 1K RAM, TTY interface and programable peripheral interface; 16K RANDOM ACCESS MEMORY (RAM) board (SBC 016); and I/O EXPANSION board (SBC 508).

A/D, D/A display unit for converting the digital data from the digital computer section into analog signals and converting the analog signals into digital data is provided.

Input signals to the digital computer includes the digital value obtained by A/D converter 14 converting the output voltage provided from the surface potential measuring probe through the surface potential measuring device 13, and the pulse generated by a pulse generator 18, coupled to the rotary drive shaft of the photosensitive drum, in response to the rotation of the drum. On the other hand, the output signal from the digital computer is the control signal for controlling the primary and the secondary voltage source. First, the input signal from the probe is compared with the values of the reference potentials $V_{DR}$ and $V_{LR}$ pre-stored in the digital computer to obtain $x=V_{DR}-V_D$ and $y=V_{LR}-V_L$, and these are substituted into optimal control functions f(x,y) and g(x,y), to calculate ΔEp=f(x,y) and $\Delta E_{AC}$=g(x,y). The digital value of ΔEp so obtained is imparted to D/A converter 5, by which it is converted into analog voltage a, which in turn is applied as control signal to the primary voltage source 4. The primary voltage source 4 is designed, for example, such that an oscillation output having an amplitude corresponding to the magnitude of the input signal a is applied to the primary winding of the transformer thereof from a DC-DC converter and is boosted and taken out at the secondary side output, and then rectified into a high DC voltage. Thus, a high DC voltage proportional to the converted voltage a or the output signal is supplied to the discharge wire 3 of the primary charger 2.

On the other hand, the digital value of $\Delta E_{AC}$ is imparted to another D/A converter 9, by which it is converted into analog voltage b which in turn is applied as input to AC power source 8. The AC power source 8 may be designed, for example, such that an oscillator output having an amplitude corresponding to the magnitude of input signal b is applied to the primary winding of the transformer thereof from DC-AC converter and is boosted and taken out at the secondary side output to provide an AC voltage without being rectified. Alternatively, the AC power source 8 may comprise an AC transformer having an insulated secondary winding for boosting a commercially available AC voltage to 5–10 KV, and a DC power source similar to the primary voltage source 4 and having its output connected to one end of sad secondary winding. The analog voltage b applied as input is connected to the DC power source. Thus, a high AC voltage proportional to the input signal b or biased by a bias voltage proportional to the input signal is provided at the output of the AC voltage source 8 and applied to the charging wire 7 of the AC charger 6. As the method of controlling the surface potential of the photosensitive medium during each of the above-described steps, not only controlling each of the applied voltages but also controlling a bias voltage applied to a grid provided between the charging wire of the charger and the photosensitive medium is effective.

The locations on the photosensitive drum 1 whereat the dark region potential $V_D$ and the light region potential $V_L$ are measured may be either the image formation region or the image non-formation region. Where the measurement is effected on the image non-formation region such as the end portion of the photosensitive drum, stabilization of the latent image may take place while recording of image is taking place. On the other hand, where the measurement is effected on the image formation region, stabilization of the latent image may advantageously take place in a sequence provided for correcting the latent image potential prior to the image formation.

Particularly, where a single measuring probe is used, both the light and the dark region must be measured by that probe. Therefore, in order that light and dark regions may be formed at the measurement locations on the photosensitive drum 1, the light source 10 is turned on and off with suitable timing under the control of the digital computer 25 in accordance with the procedure of FIG. 3.

The light source for forming the light and dark regions to be measured may be either a source of exposure light as shown in the embodiment of FIG. 1 or a light source provided exclusively for the measurement. Particularly, where the measurement is effected on the image formation region of the photosensitive drum, the original used may be a chart comprising alternately arranged white and black images. Also, where the light source used for recording is CRT or laser beam, change-over signal between white and black is made to act as the light source for measurement.

In the apparatus of FIG. 1, as already noted, the drum rotation pulse generator 18 for generating pulse in response to the rotation of the drum is coupled to the rotary drive shaft of the photosensitive drum. By the count of such pulse, the change-over between the light and the dark of the exposure or the timing for the measurement of the surface potential is provided in accordance with the time required for the photosensitive medium to move from each charger to the position of the probe. Thus, the output of the pulse generator 18 is applied to the digital computer and the count of such pulse provides said timing.

The provision of such a pulse generator is effective where the rotational velocity of the photosensitive drum is to be varied (namely, where the photosensitive drum having a plurality of velocities is used with change-over between the velocities. In the manner described above, the electrostatic latent image on the photosensitive drum is stabilized. In the apparatus of the embodiment shown in FIG. 1, application of a bias voltage during development is possible to provide good reproduction of the formed electrostatic latent image.

By controlling such bias voltage, stabilized image formation may be further expedited. The reason is that even when the bias is to be changed with variations in various factors such as temperature, humidity, aging, etc., the designated digital value from the digital computer is converted into analog voltage c by the D/A converter 17 as is the aforementioned charging voltage, so that a bias voltage proportional to the analog voltage c is supplied to the developing device 15 to enable optimal development.

Table 4 below shows an example of the program for carrying out the control method of FIG. 4 in the abovedescribed apparatus. This Table progresses from left to right and from top to bottom.

For further details of the program, see Intel Company's 8008 and 8080 PL/M Programming Manual, 8080 PL/M Compiler Operator's Manual, and 8080 PL/M EXECUTION PROGRAMMER'S MANUAL.

What I claim is:

1. A method of stabilizing an electrostatic latent image in the process of forming an electrostatic latent image on a photosensitive medium comprising a conductive layer, an insulating layer which does not become conductive by imagewise exposure, and a photoconductive layer interposed between said conductive and insulating layers and which becomes conductive by imagewise exposure through at least two kinds of charging steps, one of which is for sensitizing the photosensitive medium for image formation thereon, and the other of which is for forming a charge pattern in accordance with a light image, said method comprising the steps of measuring the dark region potential $V_D$ and the light region potential $V_L$ on the photosensitive medium, comparing the measurement values with a predetermined referential dark region potential $V_{DR}$ and a predetermined referential light region potential $V_{LR}$, respectively, and when the differences between said $V_D$, $V_L$ and said $V_{DR}$, $V_{LR}$ are not within predetermined ranges, setting the amount of control for each of the charging steps to be controlled by control functions f(x,y) and g(x,y), respectively, in which the differences $x=V_{DR}-V_D$ and $y=V_{LR}-V_L$ are variables, and controlling the amount of charging during each charging step in accordance with said set amount of control.

2. A method according to claim 1, wherein all of said steps are repeated until said differences come into said predetermined ranges.

3. A method according to claim 1, wherein said dark region potential and said light region potential of said photosensitive medium are measured a predetermined number of times and said control functions are determined by the measurement values.

4. A method according to claim 1, wherein all of said steps are repeated until $|x|<\delta$ and $|y|<\epsilon$, where $\delta$ and $\epsilon$ are predetermined values.

5. A method of stabilizing an electrostatic latent image in the process of forming an electrostatic latent image on a photosensitive medium comprising a conductive layer, an insulating layer which does not become conductive by imagewise exposure, and a photoconductive layer interposed between said conductive and insulating layers and which becomes conductive by imagewise exposure through at least two kinds of charging steps, said method comprising the steps of applying to said photosensitive medium: a primary charge of a predetermined polarity, an AC discharge or secondary charge of the opposite polarity, image light simultaneously with said discharge or secondary charge step, subsequently subjecting said photosensitive medium to whole surface exposure to form a dark region potential $V_D$ and a light region potential $V_L$ on said photosentative medium, measuring said dark region potential $V_D$ and said light region potential $V_L$ on said photosensitive medium simultaneously or successively, comparing the measured potentials with a predetermined referential dark region potential $V_{DR}$ and a predetermined referential light region potential $V_{LR}$, respectively, and when the differences between said $V_D$, $V_L$ and said $V_{DR}$, $V_{LR}$ are not within predetermined ranges, setting the amount of control for each of the charging steps to be controlled by control functions f(x,y), and g(x,y), respectively, in which the differences $x=V_{DR}-V_D$ and $y=V_{LR}-V_L$ are variables, and controlling the voltages applied during said charging and said discharging or secondary charging in accordance with said set amount of control to vary the potential of the latent image on said photosensitive medium.

6. A method according to claim 5, wherein all of said steps are repeated until said differences come into said predetermined ranges.

7. A method according to claim 5, wherein said dark region potential and said light region potential of said photosensitive medium are measured a predetermined number of times and said control functions are determined by the measurement values.

8. A method according to claim 5, wherein all of said steps are repeated until $|x|<\delta$ and $|y|<\epsilon$, where $\delta$ and $\epsilon$ are predetermined values.

9. A method of stabilizing an electrostatic latent image in the process of forming an electrostatic latent image on a photosensitive medium comprising a conductive layer, an insulating layer which does not become conductive by imagewise exposure, and a photoconductive layer interposed between said conductive and insulating layers and which becomes conductive by imagewise exposure through at least two kinds of charging steps, one of which is for sensitizing the photosensitive medium to receive an image formation thereon, and the other of which is for forming a charge pattern in accordance with a light image, said method comprising the steps of measuring the dark region potential $V_D$ and the light region potential $V_L$ on the photosensitive medium, comparing the measurement values with a predetermined referential dark region potential $V_{DR}$ and a predetermined referential light region potential $V_{LR}$, respectively, calculating the amount of control for each of the charging steps to be controlled, by control functions f(x,y) and g(x,y), in which the difference $x=V_{DR}-V_D$ and $y=V_{LR}-V_L$ are variables controlling the amount of charge in said each of the steps by the calculated amount of control when the amount of control does not exceed a predetermined value.

10. A method according to claim 9, wherein when one of the calculated amounts of control exceeds the corresponding predetermined value, the corresponding charging step is controlled by the predetermined value.

11. A method according to claim 9, wherein all of said steps are repeated until $|x|<\delta$ and $|y|<\epsilon$, where $\delta$ and $\epsilon$ are predetermined values.

12. A method of stabilizing an electrostatic latent image in a process of forming an electrostatic latent image on a photosensitive medium comprising a conductive layer, an insulating layer which does not become conductive by imagewise exposure, and a photoconductive layer interposed between said conductive and insulating layers and which becomes conductive by imagewise exposure by plural process means, said method comprising the steps of:

varying the setting conditions of two image forming process means to form sequential light and dark images on said photosensitive medium and measuring the surface potentials at the light and dark images; and then setting the amount of control for each of said two process means by control functions f(x,y) and g(x,y), in which $x=V_{DR}-V_D$ and $y=V_{LR}-V_L$, said functions including a coefficient which is determined by the measured values of the surface potentials at the light and dark images and said setting conditions.

13. A method according to claim 12, wherein, in said varying step, the setting condition of at least one of said two process means is changed.

* * * * *